US006260565B1

(12) United States Patent
Welch et al.

(10) Patent No.: US 6,260,565 B1
(45) Date of Patent: Jul. 17, 2001

(54) DOUBLE DISHWASHER

(75) Inventors: Rodney M. Welch, Jackson, TN (US); Stephen L. Birkenholtz; Douglas M. Ringger, both of Newton, IA (US); Juda J. Cordle, Decaturville, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/157,461

(22) Filed: Sep. 21, 1998

(51) Int. Cl.[7] ..... B08B 13/00
(52) U.S. Cl. ..... 134/200; 134/201; 312/228
(58) Field of Search ..... 134/56 D, 57 D, 134/58 D, 88, 200, 201, 115 R; 312/228

(56) References Cited

U.S. PATENT DOCUMENTS

| | | | |
|---|---|---|---|
| D. 400,320 | | 10/1998 | Brace . |
| 2,024,952 | | 12/1935 | Snyder et al. . |
| 2,216,388 | * | 10/1940 | Hampel . |
| 2,380,604 | * | 7/1945 | Melton . |
| 2,704,082 | | 3/1955 | Jackson . |
| 3,217,721 | * | 11/1965 | Hertel . |
| 3,230,961 | * | 1/1966 | Benkert et al. . |
| 3,288,154 | * | 11/1966 | Jacobs . |
| 3,358,702 | * | 12/1967 | Schaap . |
| 3,586,011 | * | 6/1971 | Mazza . |
| 3,718,149 | * | 2/1973 | Mazza . |
| 3,759,276 | * | 9/1973 | Nolte . |
| 3,910,499 | | 10/1975 | Trouilhet . |
| 4,146,405 | * | 3/1979 | Timmer et al. . |
| 4,179,307 | * | 12/1979 | Cau et al. . |
| 5,017,852 | | 5/1991 | Nagata et al. . |
| 5,046,517 | | 9/1991 | Maruyama et al. . |
| 5,184,635 | | 2/1993 | Tromblee et al. . |
| 5,331,986 | * | 7/1994 | Lim et al. . |
| 5,470,142 | | 11/1995 | Sargeant et al. . |
| 5,617,885 | | 4/1997 | Centis . |
| 5,642,742 | | 7/1997 | Noren et al. . |
| 5,651,380 | | 7/1997 | Sargeant et al. . |
| 5,651,382 | | 7/1997 | Sargeant et al. . |
| 5,660,193 | | 8/1997 | Archer et al. . |
| 5,709,237 | | 1/1998 | Sargeant et al. . |
| 5,743,281 | | 4/1998 | Sargeant et al. . |
| 5,755,244 | | 5/1998 | Sargeant et al. . |
| 5,762,080 | | 6/1998 | Edwards et al. . |
| 5,829,459 | | 11/1998 | Milocco et al. . |
| 5,934,298 | * | 8/1999 | Singh . |

FOREIGN PATENT DOCUMENTS

| | | |
|---|---|---|
| 0 585 905 | 3/1994 | (EP) . |
| 1 500 537 | 1/1968 | (FR) . |
| 0 640 487 | 6/1990 | (FR) . |

* cited by examiner

*Primary Examiner*—Frankie L. Stinson
(74) *Attorney, Agent, or Firm*—Zarley, McKee, Thomte, Voorhees & Sease

(57) ABSTRACT

A dishwasher cabinet has a front wall, a rear wall, and opposite sidewalls. The cabinet has an intermediate wall for forming the cabinet into a first compartment and a second compartment. The front wall has a first opening and a second opening providing access into the first and second compartments respectively. First and second doors are in covering relation over the first and second openings and are movable between open and closed positions.

9 Claims, 3 Drawing Sheets

DOUBLE DISHWASHER

BACKGROUND OF THE INVENTION

The present invention relates to a double dishwasher.

Conventional dishwashers include a single compartment for washing dishes. However, such a single compartment construction is inefficient when only a few items are needed to be washed. Additionally dirty items cannot be placed in the single compartment dishwasher while the dishwasher is running or until after the clean items have been removed.

Therefore a primary object of the present invention is the provision of an improved double dishwasher.

A further object of the present invention is the provision of a double dishwasher having two compartments which can be operated independently of one another.

A further object of the present invention is the provision of a double dishwasher having one compartment smaller than the other for washing smaller batches of items to be washed.

A further object of the present invention is the provision of a double dishwasher which permits dirty items to be placed in one washing compartment while clean items are being washed or have not yet been removed from the other compartment.

A further object of the present invention is the provision of a double dishwasher which is efficient in operation and durable in manufacture.

SUMMARY OF THE INVENTION

The foregoing objects may be achieved by a dishwasher having a dishwasher cabinet with a front wall, a rear wall, and opposite side-walls. The cabinet has an intermediate wall forming the cabinet into a first compartment and a second compartment. The front wall has a first opening and a second opening therein providing access to the first and second compartments respectively. A first door is fitted in covering relation over the first opening and is movable from a closed position in covering relation over the first opening to an open position providing access to the first compartment. A second door is in covering relation over the second opening and is movable from a closed position in covering relation over the second opening to an open position providing access to the second compartment.

While the relative sizes of the compartments may vary, it is preferable that one compartment be smaller than the other so as to accommodate different sizes of batches of items to be washed.

While the types of doors over the two compartments may vary without detracting from the invention, it is preferable that the one of the compartments have a drawer mounted therein for sliding movement. The lower compartment is preferably a hinged door.

DETAILED DESCRIPTION OF THE PREFERRED EMBODIMENT

Figure 1:
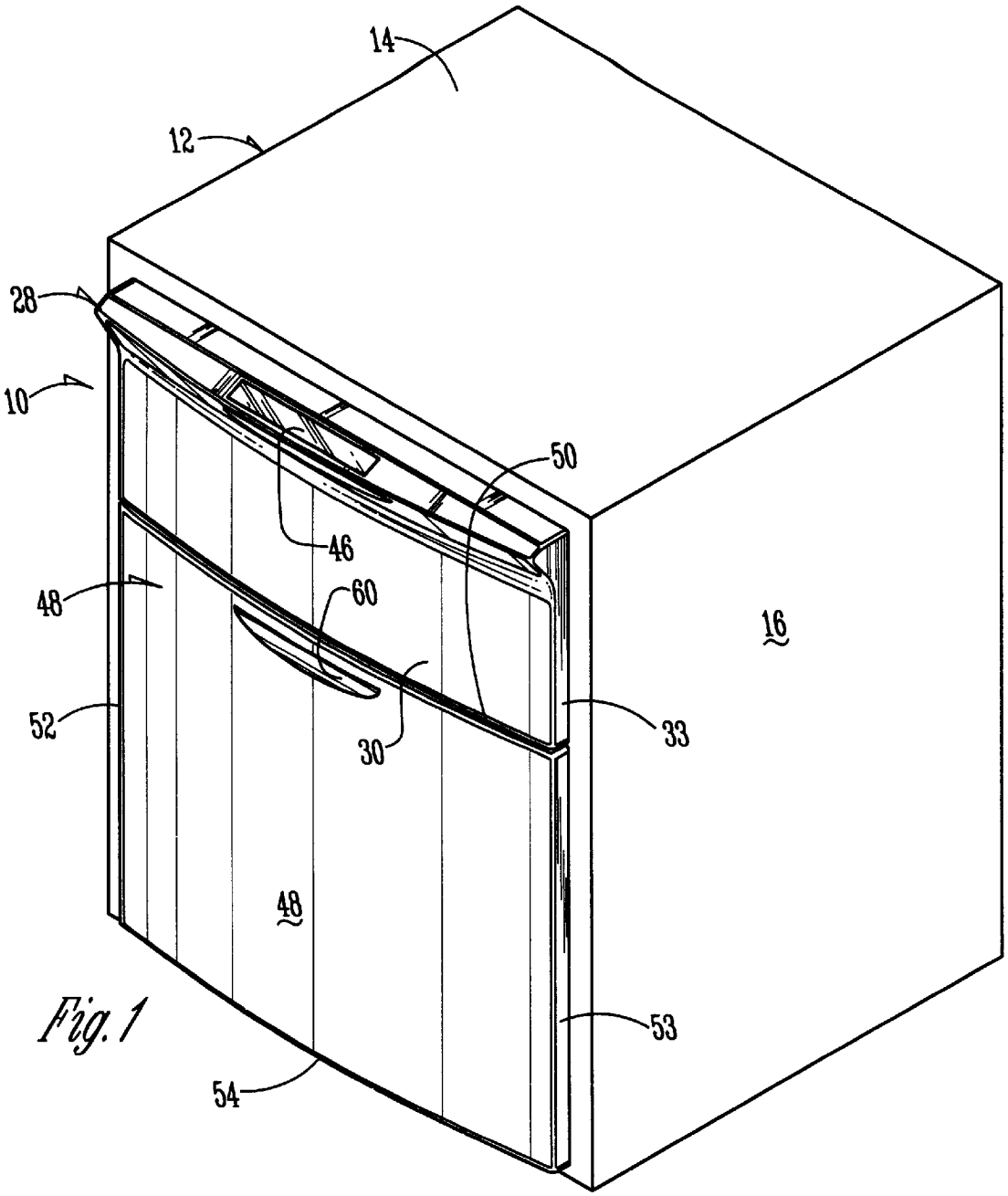
FIG. 1 is a perspective view of the double dishwasher of the present invention.

Referring to the drawings a dishwasher 10 includes a cabinet 12 having a top wall 14, sidewalls 16, 18, and a bottom wall 20. An intermediate wall 22 divides the cabinet into an upper washing compartment 24, and a lower washing compartment 26. While the two compartments are shown in upper and lower relation to one another it is also possible to orient them differently, for example side by side.

Mounted within the upper compartment 24 is a drawer 28 having an upper door 30 at its front. Upper door 30 includes a top edge 31, side edges 32, 33, and a bottom edge 34. Drawer 28 also includes sidewalls 35, 36, a bottom wall 37, and a rear wall (not shown). Upper door 30 provides the front wall for the drawer 28. Within the drawer 28 is a rack 38 for supporting dishes or other items to be washed. The structure of the rack may vary without detracting from the invention, but such racks usually contain tines 40 which help support the items to be washed.

Figure 2:
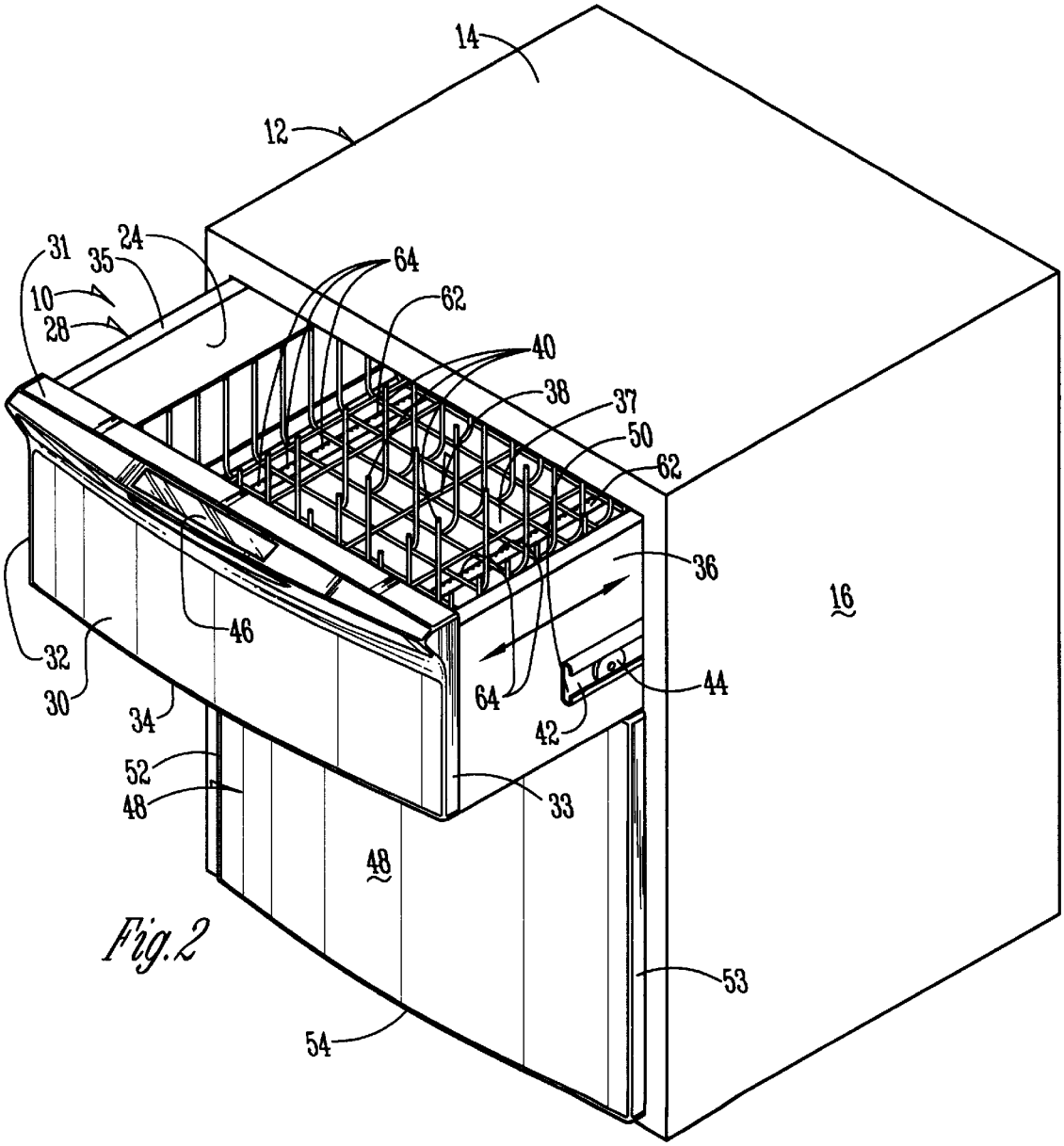
FIG. 2 is a perspective view showing the upper drawer partially removed from the upper washing compartment.

The particular dishwashing apparatus within drawer 28 may vary according to any number of conventional washing devices. Rotating arms, sprayers, and other types of dishwasher actions may be provided in the drawer 28. FIG. 2 shows a pair of tubes 62, having spray perforation 64 therein for spraying cleaning fluid on the items to be washed. Tubes 62 are adapted to rotate about their longitudinal axis and are connected to a source of pressurized fluid (not shown).

Figure 3:
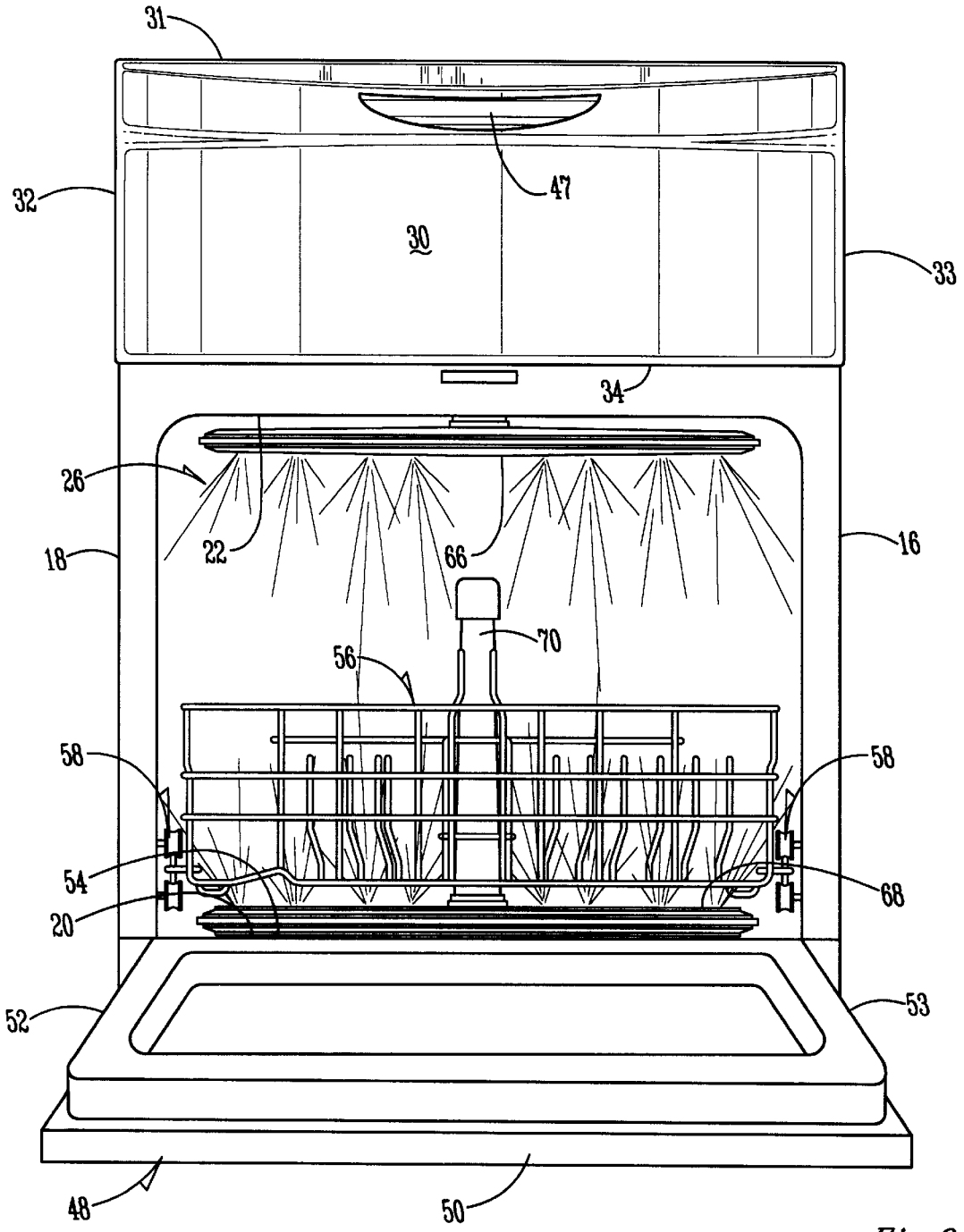
FIG. 3 is a front elevational view showing the hinged door in its opened position providing access to the lower washing compartment.

Drawer 28 also includes a side track 42 having a roller 44 mounted therein so that the drawer can be rolled from its closed position shown in FIGS. 1 and 3, to its opened position shown in FIG. 2. A control panel 46 is provided adjacent the upper edge 31 of door 30. Also a handle 47 (FIG. 3) is provided for permitting grasping of the door 30 to roll it between its closed and open positions.

A lower door 48 includes a top edge 50, side edges 52, 53, and a bottom edge 54. Door 48 is hinged adjacent its bottom edge 54 for hinged movement from the position shown in FIG. 1 to the position shown in FIG. 3.

As can be seen in FIG. 3, the lower compartment 26 includes a rack 56 mounted therein for supporting items to be washed. Rack 56 is suspended for rolling movement by rollers 58 so that it may be rolled inwardly and outwardly from the washing compartment 26 in a conventional manner. Door 48 includes a handle 60 (FIG. 1) for permitting the grasping of the door to move it from its closed to its open positions.

Conventional upper and lower washing arms 66, 68, as well as a central spray tower 70, are shown for spraying the items within the lower compartment 26. There are many types of washing apparatus well-known in the art which could be used in both the upper compartment and the lower compartment.

In use, items to be washed are placed washed in the lower compartment, and while those dishes are being washed, additional dirty dishes or items can be placed in the upper compartment. Also, because the upper compartment is of a smaller size, smaller batches of items to be washed can be placed in the upper compartment, thereby adding to the efficiency of the washing machine and minimizing the amount of water and energy needed to wash a small batch of dishes.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A dishwasher comprising:

a dishwasher cabinet having a front wall, a rear wall, and opposite side walls;

said cabinet having an intermediate wall forming said cabinet into a first compartment and a second compartment wherein said first compartment is smaller than said second compartment;

said front wall having a first opening and a second opening therein providing access to said first and second compartments respectively; and a first door in covering relation over said first opening;

a second door in covering relation over said second opening;

said first and second doors each being independently movable from a closed position in covering relation over said first and second openings, respectively, to an open position providing access to said first and second compartments, respectively;

said first door being attached to a drawer which is mounted in said first compartment for sliding movement therein;

said second door being hinged to said cabinet for hinged movement between said open and said closed positions.

2. A dishwasher according to claim 1 wherein a first rack is mounted within said first compartment and a second rack is mounted within said second compartment, said first and second racks being adapted to support objects to be washed within said first and second compartments.

3. A dishwasher according to claim 1 wherein said first compartment is above said second compartment.

4. A dishwasher comprising:

a dishwasher cabinet having a front wall, a rear wall, and opposite side walls;

said cabinet having an intermediate wall forming said cabinet into a first compartment and a second compartment wherein said first compartment is smaller than said second compartment;

said front wall having a first opening and a second opening therein providing access to said first and second compartments respectively;

a first door in covering relation over said first opening;

a second door in covering relation over said second opening;

said first door being movable from a closed position in covering relation over said first opening to an open position providing access to said first compartment wherein said first door is attached to a drawer which is mounted in said first compartment for sliding movement therein; and said second door being movable from a closed position in covering relation over said second opening to an open position providing access to said second compartment wherein said second door is hinged to said cabinet for hinged movement between said open and said closed positions.

5. A dishwasher according to claim 4 wherein a first rack is mounted within said first compartment and a second rack is mounted within said second compartment, said first and second racks being adapted to support objects to be washed within said first and second compartments.

6. A dishwasher comprising:

a dishwasher cabinet having a top wall, side walls, a bottom wall, and an intermediate wall dividing said cabinet into an upper washing compartment with an upper front opening and a lower washing compartment with a lower front opening;

an upper rack within said upper compartment for supporting objects to be washed;

a lower rack mounted within said lower compartment for supporting objects to be washed;

an upper washing mechanism within said upper washing compartment for spraying washing fluid on said objects within said upper washing compartment;

a lower washing mechanism within said lower washing compartment for spraying washing fluid on said objects within said lower washing compartment;

a drawer mounted within said upper compartment having an upper door at its front, side walls, a bottom wall, and a rear wall;

drawer mounting mechanism mounting said drawer within said upper washing compartment for movement from a drawer closed position with said drawer front wall in covering relation over said upper front opening to a drawer open position providing access into said drawer from outside said cabinet;

said upper rack being within said drawer and movable with said drawer from said closed to said open position;

said upper spray mechanism being completely above said bottom wall of said drawer;

a lower door movable from a closed position in covering relation over only said lower washing compartment to an open position permitting access to said lower washing compartment from outside said cabinet.

7. A dishwasher according to claim 6 and being further characterized by said lower door being hinged for hinged movement between said closed and said open positions.

8. A dishwasher according to claim 6 and being further characterized by said upper washing compartment and said upper door being smaller than said lower washing compartment and said lower door, respectively.

9. A dishwasher according to claim 6 and being further characterized by said upper spray mechanism being at least partially within said drawer and movable with said drawer between said open and said closed positions.

* * * * *